United States Patent [19]

Kotera

[11] Patent Number: 4,614,098

[45] Date of Patent: Sep. 30, 1986

[54] METHOD OF AND APPARATUS FOR CONTROLLING LOAD DISTRIBUTION FOR A CONTINUOUS ROLLING MILL

[75] Inventor: Yoshikazu Kotera, Hyogo, Japan

[73] Assignee: Mitsubishi Denki Kabushiki Kaisha, Tokyo, Japan

[21] Appl. No.: 649,679

[22] Filed: Sep. 12, 1984

[30] Foreign Application Priority Data

Sep. 13, 1983 [JP] Japan ..... 58-169691

[51] Int. Cl.[4] ..... B21B 37/12

[52] U.S. Cl. ..... 72/8; 72/17; 72/20; 72/21; 72/234; 72/240; 364/472

[58] Field of Search ..... 72/8, 16, 20, 234, 21, 72/240, 17; 364/472

[56] References Cited

U.S. PATENT DOCUMENTS 4,485,497 12/1984 Miura ..... 72/8 X

*Primary Examiner*—Francis S. Husar
*Assistant Examiner*—Steve Katz
*Attorney, Agent, or Firm*—Bernard, Rothwell & Brown

[57] ABSTRACT

A method of and apparatus for correcting the rolling load distribution ratio between given stands in a continuous rolling mill involves comparison of rolling load amounts at a pair of adjacent stands with a load distribution ratio set value. When coincidence is not found, the plate thickness on the exit side of an upstream side one of the pair of stands is changed, and at a time when a plate thickness changing point reaches the downstream side stand, the rolling reduction position at the downstream side stand is corrected so as not to change the plate thickness on the exit side of the downstream side stand.

2 Claims, 2 Drawing Figures

METHOD OF AND APPARATUS FOR CONTROLLING LOAD DISTRIBUTION FOR A CONTINUOUS ROLLING MILL

FIELD OF THE INVENTION

This invention relates to a continuous rolling mill, and more particularly to a load distribution controlling method and apparatus for controlling the load distribution ratios of the rolling load amounts of the stands of a continuous rolling mill among all of the stands to respective load distribution ratio set values in a short period of time.

PRIOR ART

Generally, a plate thickness reduction ratio at each of the stands in a continuous rolling mill is determined, taking into consideration stabilized operation, configuration and quality, and so on, in addition to the plate thickness of a base metal, the plate thickness of the manufactured products, and various ratings of the rolling mill, such that a rolling load amount at each stand, that is, a load distribution ratio, may be a preset value.

However, due to various disturbances such as an accuracy limit of a rolling model expression, characteristics of the rolling mill and so on, there are many cases in which actual rolling load amounts do not coincide with respective estimated values, causing an error of the plate thickness, width, and so on, of the products manufactured, unacceptable configuration, unstable rolling, stopping of rolling due to exceeding the rating of a device, and other problems.

Of these problems, the plate thickness error and the plate width error are not serious if an automatic controlling mechanism is provided therefor. However the deviation of a rolling load amount at each rolling stand from a proper load distribution ratio preset value does present a problem. Namely at present, an operator of the mill manually operates the mill at a suitable point of time while he watches the rolling condition in order to continue the operation of the mill while ensuring the accuracy in dimension of the products.

SUMMARY OF THE INVENTION

It is an object of the present invention to provide a load distribution controlling method and apparatus for a continuous rolling mill which can prevent production of unsatisfactory products, avoid stopping of rolling due to load unbalance and exceeding of a load limit, stabilize the rolling operation, and reduce the physical and mental burdens of an operator of the mill. This accomplished by providing a method and apparatus such that a load distribution ratio of a rolling load amount at each stand is brought into and held in coincidence with a load distribution ratio preset value at a high speed without having any adverse influence on the accuracy of the plate thickness of the products produced.

A load distribution controlling method and apparatus for a continuous rolling mill according to the present invention comprises detecting rolling load amounts at a given pair of adjacent stands, judging if the rolling load amounts coincide with a load distribution ratio preset value or not, changing, if coincidence is not found, the plate thickness on the exit side of the upstream one of the pair of stands based on the deviation of the rolling load amounts from the load distribution ratio preset value, correcting the rolling reduction position at the downstream one of the pair of stands at a time when a plate thickness changing point reaches the downstream stand, and changing the load distribution ratio between the adjacent stands to the load distribution ratio preset value while maintaining the plate thickness error on the exit side of the downstream stand.

DETAILED DESCRIPTION OF THE PREFERRED EMBODIMENTS

Figure 1:
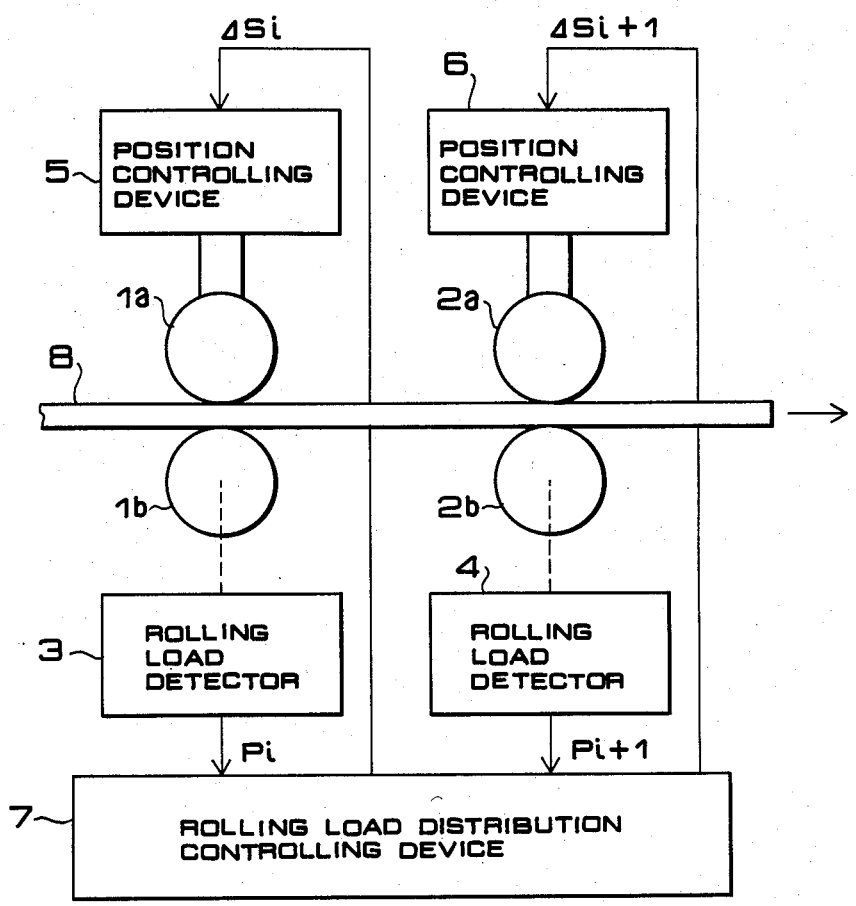
FIG. 1 is an illustrative view showing a first embodiment of an apparatus for putting into practice a load distribution controlling method for a continuous rolling mill according to the present invention.

Among factors which determine rolling loads at individual stands, in a continuous rolling mill, there is a strict mass flow balance restriction between a rolling velocity at an upsteam one and another rolling velocity at a downstream one of a given pair of adjacent stands, and a rolling velocity cannot be freely selected independently for a given stand.

Meanwhile, correction of a plate thickness rolling reduction rate can be chosen as a factor which can be operated arbitrarily at individual stands. Correction of a plate thickness rolling reduction rate can be realized by changing the magnitude of a roll gap to vary the plate thickness at the exit side. Now it is assumed that a given pair of adjacent stands are designated an ith stand and an i+1th stand.

A first aspect of the present invention is characterized in that load distribution is controlled such that only a load distribution ratio between two stands is corrected without having an influence on rolling loads and the plate thickness at the remaining stands. Accordingly, the load distribution ratio is corrected between the two stands under following two conditions:

(1) the plate thickness at the entry side, that is at the upstream side, of the ith stand is not varied; and (2) the plate thickness at the exit side, that is, at the downstream side, of the i+1th stand is not varied.

If the plate thickness at the entry side at the ith stand is changed, then this will require a change of the plate thickness rolling reduction ratio at the i−1th stand which is positioned further upstream, and hence a problem which disturbs the load distribution balance between another pair of stands (i−2th, i−1th) may result. Thus, the first condition (1) is necessary to prevent this problem.

Meanwhile, the second condition (2) is necessary to prevent a possibility that a change of the plate thickness at the exit side of the i+1th stand may cause a change of the load at the i+2th stand on the downstream side, disturbing the load distribution ratio at the pair of stands (i+1th and i+2th), resulting in a change of the plate thickness of a product on the exit side of the final stand to adversely affect the accuracy of the product. There is also the possibility that an operation to correct the plate thickness of a product to a set point by gage monitor control based on plate thickness measurement on the exit side of the final stand disturb to the load distribution ratio at stands further downstream.

In this way, according to the invention, at a given pair of stands, load distribution ratio changing control which does not cause a change of the plate thickness on the exit side of the downstream one of the paired stands is attained, and hence, the influence on the remaining stands is very small, the time required for adjustment is very short and the control does not disturb the plate thickness of a product, and the load distribution ratio changing control is appropriate for the actual conditions of rolling operations. Now, details of operations will be described.

Changes of the rolling load at the ith and i+1th stands are expressed as follows:

$$\Delta Pi = Qi^H \Delta Hi + Qi^h \Delta hi \quad (1)$$

$$\Delta Pi+1 = Qi^H+1 \Delta Hi+1 + Qi^h+1 \Delta hi+1 \quad (2)$$

where

ΔHi, ΔHi+1: a change of the plate thickness on the entry side of the stand,

Δhi, Δhi+1: a change of the plate thickness on the exit side of the stand,

ΔPi, ΔPi+1: a change of the rolling load at the stand, $Qi^H$, $Qi^H+1$: sensitivity of the influence of ΔH on ΔP, and $Qi^h$, $Qi^h+1$: sensitivity of the influence of Δh on ΔP.

The sensitivity of the influence $\{Q^H\}$, $\{Q^H\}$ depends upon the type or kind of the steel, the plate thickness and so on, but it is assumed that substantially accurate values of the sensitivity are already known for each the rolling conditions. Further it is assumed that values of the rolling loads Pi, Pi+1 can be measured at any time during rolling. When distribution ratio designated values of these are Ci and Ci+1, it is an object of the control according to the invention to attain the following load distribution ratio $$(Pi+\Delta Pi):(Pi+1+\Delta Pi+1) = Ci:Ci+1 \quad (6)$$

under the conditions that, of the variables in the equations (1) and (2) above, the plate thickness ΔHi at the entry side of the ith stand and the plate thickness Δhi+1 at the exit side of the i+1th stand are not changed, that is, $$\Delta Hi = 0 \quad (3)$$

$$\Delta hi+1 = 0 \quad (4)$$

$$\Delta Hi+1 = \Delta hi \quad (5)$$

A plate thickness change value $hi(=Hi+1)$ which is necessary to establish the equation (6) is determined as follows: that is, $$erri = Ci \cdot Pi+1 - Ci+1 \cdot Pi \quad (7)$$

$$di = -Ci+1 \cdot Qi - Ci \cdot Qi+1 \quad (8)$$

and then $$\Delta hi^L = -(erri/di) \quad (9)$$

Here, for simplification, it is assumed that an influence Qi on the rolling load of a change of the plate thickness on the entry side and an influence Qi on the rolling load of a change of the plate thickness on the exit side have a following relationship. (Q will not hereinafter accompany a superscript)

$$Qi^h = -Qi^H \quad (10)$$

When changing of the plate thickness determined by the equations (5) and (9) is carried out at the ith and i+1th stands, the rolling loads after modification of the load distribution between the stands will change, in accordance with the equations (1), (2) and (7) to (9) above, to P'i and P'i+1 indicated below:

$$\begin{pmatrix} P'i \\ P'i+1 \end{pmatrix} = \begin{pmatrix} Pi \\ Pi+1 \end{pmatrix} + \begin{pmatrix} \Delta Pi \\ \Delta Pi+1 \end{pmatrix} \quad (11)$$

$$= \begin{pmatrix} Pi \\ Pi+1 \end{pmatrix} + \begin{pmatrix} -Qi \\ Qi+1 \end{pmatrix} \frac{(-Ci+1, Ci)}{di} \begin{pmatrix} Pi \\ Pi+1 \end{pmatrix}$$

$$= \begin{pmatrix} Ci \\ Ci+1 \end{pmatrix} \frac{(-Qi+1, -Qi)}{di} \begin{pmatrix} Pi \\ Pi+1 \end{pmatrix}$$

In this manner, it will be apparent that the load distribution ratio (P'i:P'i+1) after modification can be made coincide with a desired distribution ratio (Ci:Ci+1) for any value of Pi and Pi+1.

Subsequently, description will be given of determination of the rolling reduction position correcting amounts at the ith and i+1th stands which are required to attain a change of the plate thickness indicated here. If the mill spring constant of a rolling mill at each stand is indicated by mi and the plasticity hardness of the rolling material is indicated by qi, a necessary rolling reduction position modification amount is determined, at the ith stand, in accordance with an equation $$\Delta S_i = (m_i + q_i m/i) \cdot \Delta h_i^L \quad (12)$$

while, at the i+1th stand, a rolling reduction position modification amount which does not change the plate thickness on the exit side relative to the change of the plate thickness $\Delta Hi^L+1(=\Delta hi^L)$ on the entry side is determined by a following equation $$\Delta S_{i+1} = (q_{i+1}/m_{i+1}) \cdot \Delta h_i^L \quad (13)$$

It is assumed that the time of a rolling reduction position correcting operation at the i+1th stand coincides with a point of time at which the plate thickness changing point at the ith stand reaches the i+1th stand.

Further, according to the invention, in a continuous rolling mill having a roll force plate thickness controlling device at the ith stand and a feed forward plate thickness controlling device, the stand rolling load distribution ratio is determined in a manner described below.

In the roll force plate thickness controlling device, as is well known in the art, a rolling force and a screw rolling reduction position S are measured and stored (lock on) at a suitable timing after introduction of the metal to be rolled, and based on a change ΔF of the rolling force and a change ΔS of the rolling reduction position, a variation of the plate thickness on the exit side of the stand is calculated by the following equation $$\Delta h^c = \Delta S + (\Delta F/m) \quad (14)$$

Based on a calculated value of the plate thickness variation, a rolling reduction position correcting instruction $\Delta S^*$ is determined and outputted as $$\Delta S^* = \Delta S - \frac{m+q}{m} \Delta h^c \quad (15)$$

where m and q are a mill spring constant and a plasticity hardness constant of the material, respectively. Thus, after the lock on timing, the rolling reduction position correcting instruction has a function to always hold the variation of the plate thickness on the exit side to zero against various disturbances.

In this roll force plate thickness controlling device, if a plate thickness change value $\Delta hi^L$ for modification of the load distribution determined by the equation (9) above is added as a bias to the right side of the equation (15) for calculation of the plate thickness variation, while maintaining the plate thickness control against disturbances, the plate thickness on the exit side will automatically coincide with the plate thickness change amount $\Delta hi^L$, thus attaining the intended plate thickness change.

Meanwhile, in the feed forward plate thickness controlling device, based on a plate thickness deviation signal calculated or measured at the upstream one of the paired stands, rolling reduction position modification is carried out at a time when a measurement point on the material reaches the downstream one of the paired stands to always hold the plate thickness deviation at the exit side of downstream stand to zero.

A rolling reduction position correcting instruction is outputted in accordance with the following equation $$\Delta S_i^* + 1 = -\frac{qi+1}{mi+1} \Delta hf \cdot e^{-sTL} \quad (16)$$

Where mi+1 and qi+1 are a mill spring constant and a plasticity hardness constant of the material, respectively, and are already known, while $\Delta hi^c$ is an amount of plate thickness variation detected at the upstream stand, and $e^{-sTL}$ is waste time disposition corresponding to the travelling time of a steel plate between the ith and i+1th stands using a Laplacean operator S.

By the feed forward plate thickness controlling device having such a construction as described just above, all of disturbances to the plate thickness from the upstream stand are compensated at the downstream stand. Thus, it is widely known that the feed forward plate thickness controlling device has a function to maintain constant the plate thickness on the exit side of the downstream stand.

Accordingly, where a feed forward plate thickness controlling device is operating at the downstream stand for which the load distribution is to be corrected, calculation of a rolling reduction position changing amount at the i+1th stand required for the load distribution control and determination of the timing for the same are all attained in the feed forward plate thickness controlling device. As a result, the steps of the operation which are to be accomplished by a load distribution controlling device can be simplified.

Now, the present invention will be described in detail in connection with a preferred embodiment thereof illustrated in the drawings.

Referring to FIG. 1 which shows a first concrete embodiment of the invention, the upstream one of a given pair of stands is shown by a pair of rolls 1*a* and 1*b* while the downstream stand is shown by another pair of rolls 2*a* and 2*b*. To lower rolls 1*b* and 2*b* of the stands are connected rolling load detectors 3 and 4, respectively, in order to detect a rolling load at each stand. Meanwhile, connected to the upper rolls 1*a* and 2*a* of the stands are screw rolling reduction position controlling devices 5 and 6, respectively. The rolling load detectors 3 and 4 and the screw rolling reduction position controlling devices 5 and 6 are connected to a rolling load distribution controlling device 7. In FIG. 1, reference numeral 8 designates a material rolled.

Now, operations of the embodiment of FIG. 1 will be described. Rolling load amounts P1 and Pi+1 from the rolling load detectors 3 and 4, respectively, are applied to the rolling load distribution controlling device 7, and a calculation is effected in accordance with the expression (7) if the rolling load amounts coincide with the corresponding load distribution ratio set values Ci and Ci+1 or not. Thus, based on a result of the calculation, a plate thickness change amount on the exit side of the ith stand is determined as shown by the expression (9).

Subsequently, a screw rolling reduction position correcting amount $\Delta Si$ is calculated by the expression (12) using the constants qi and mi regarding the material and the rolling mill which can be known in advance, and the correcting amount is delivered from the rolling load distribution controlling device 7 to the screw rolling reduction position controlling device 5. Meanwhile, using the constants mi+1 and qi+1 which can be known in advance, a rolling reduction position correcting amount $\Delta Si+1$ at the i+1th stand which is necessary to maintain the plate thickness on the exit side of the downstream stand to a value before such modification of the load distribution is calculated by the expression (13).

Such rolling reduction position correcting instructions are delivered from the rolling load distribution controlling device 7 to the screw rolling reduction position controlling device 6 after they have undergone adjustment of timing corresponding to a travelling time between the stands of the material (steel plate) 8 being rolled which time is determined by a plate velocity calculated separately using a stand roll velocity value and also by the distance between the stands.

Accordingly, the plate thickness at the exit side of the i+1th stand does not undergo any change after the load distribution modification and hence there is no influence on other stands on the downstream side. In addition, the accuracy of the plate thickness of the product is not affected.

Figure 2:
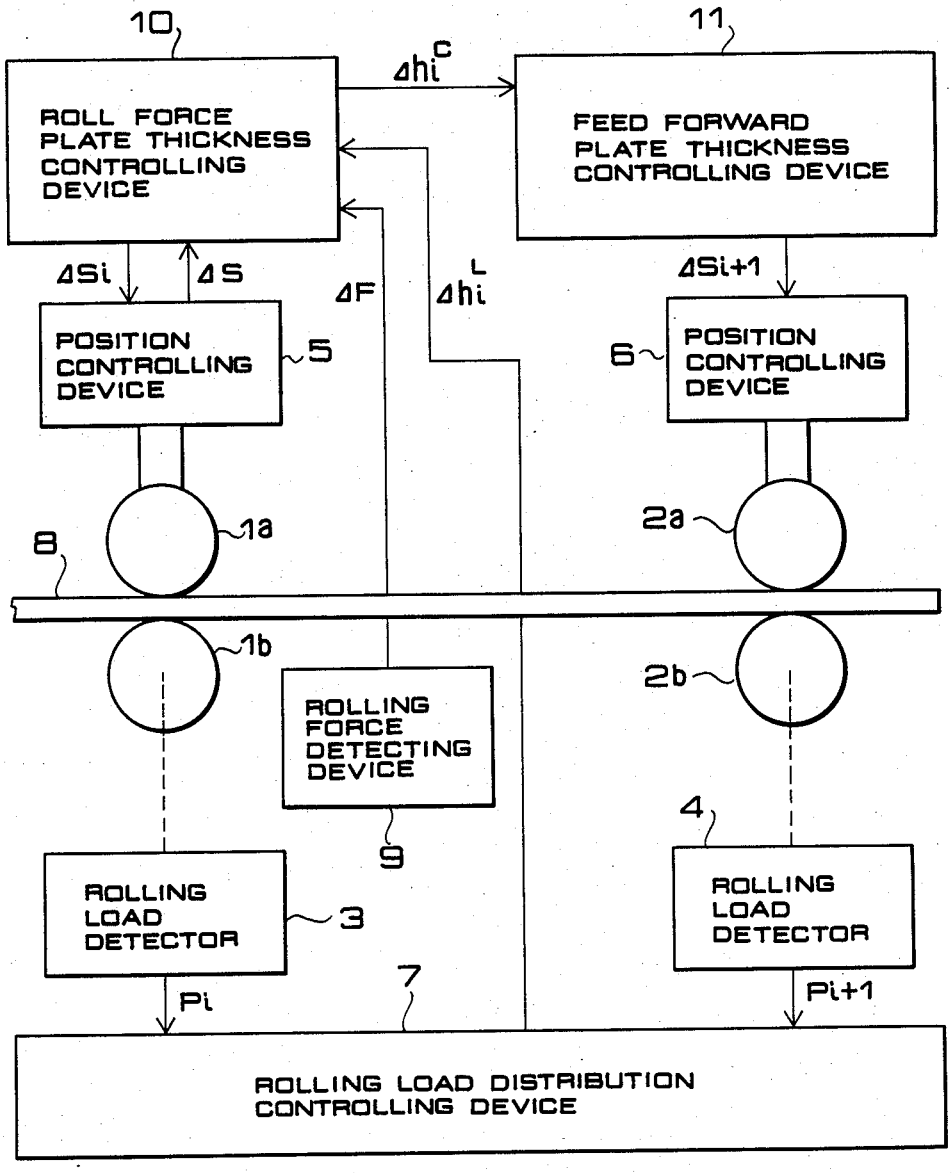
FIG. 2 is an illustrative view showing a second embodiment of an apparatus for putting into practice a load distribution controlling method for a continuous rolling mill according to the present invention.

FIG. 2 shows a second concrete embodiment of the invention in a continuous rolling mill which includes a roll force plate thickness controlling device at the ith stand and a feed forward plate thickness controlling device at the i+1th stand. In FIG. 2, reference numerals 1 to 8 designate like parts to those of FIG. 1 which are described hereinabove.

Referring to FIG. 2, reference numeral 10 designates a roll force plate thickness controlling device to which a rolling force signal $\Delta F$ from a rolling force detecting device 9 and a rolling reduction position signal $\Delta S$ from the screw rolling reduction position controlling device 5 are inputted. Consequently, calculation of the equation (14) is carried out at the roll force plate thickness controlling device 10. Meanwhile, a rolling reduction position correcting instruction $\Delta Si^*$ calculated by the equation (15) is outputted to the screw rolling reduction position controlling device 5.

The roll force plate thickness controlling device 10 is connected to the feed forward plate thickness controlling device 11 for the downstream stand so that the feed forward plate thickness controlling device 11 may determine a rolling reduction position correcting instruction $\Delta Si^{*}+1$ from the expression (16) based on a plate thickness error signal $\Delta hi^{c}$ from the roll force plate thickness controlling device 10 and deliver the instruction to the screw rolling reduction position controlling device 6 to maintain constant the plate thickness $hi+1$ at the exit side of the stand.

According to the rolling load distribution control performed under such a construction as described above, if the load distribution controlling device 7 calculates a plate thickness changing amount $\Delta h^{L}i$ on the exit side of the ith stand by the equation (9) based on detected load amounts Pi and $Pi+1$ from the rolling load detectors 3 and 4, respectively, for the paired stands and delivers it to the roll force plate thickness controlling device 10, modification of the screw position at the ith stand is automatically determined and performed. Further, by means of the feed forward plate thickness controlling device 11 operating at the downstream stand, rolling reduction position modification is performed at the $i+1$th stand at a point of time when a plate thickness changing point reaches the downstream stand to attain desired load distribution modification while the plate thickness value on the exit side of the downstream stand is always held constant.

Thus, the second embodiment has the effect that a function equivalent to that of the embodiment of FIG. 1 can be expected using a very simple load distribution controlling device. It is also a characteristic that control of the plate thickness against normal disturbances can be attained.

It is to be noted that, while in the description given hereinabove the rolling load amount designates either required rolling torque or required electric power, distribution ratio control between stands of a rolling force and a rolling reactive force are also material, and similar effects can possibly be presented without changing the spirit of the present invention.

In addition, by providing a stand rolling load correcting control of the present invention between all of stands of a continuous rolling mill, the load distribution ratios between all the stands can be corrected and maintained to set values therefor.

As apparent from the foregoing description, according to the present invention, a rolling load distribution ratio between a given pair of stands can be readily corrected in a very short period of time without varying rolling loads to other stands and without making any sacrifice of accuracy of the plate thickness of products. The present invention, in addition to ensuring of accuracy the plate thickness of products, exhibits a significant effect on prevention of the production of plate materials having an unacceptable configuration, avoidance of the stopping of the rolling operation due to load unbalance or an exceeding of a load limit, stabilization of rolling operations, maximal exploitation of the rating a machine driving of the a rolling mill, and reduction of physical and mental burdens of a mill operator.

I claim:

1. A load distribution controlling method for a continuous rolling mill for rolling plate material, comprising the steps of:

(a) detecting rolling load amounts at a given pair of adjacent stands of said continuous rolling mill;

(b) judging whether the respective rolling load ratios coincide with a load distribution ratio set value or not by comparing the respective magnitudes with each other;

(c) calculating, if coincidence is not found, a change value $\Delta hi^{L}$ of the plate thickness on the exit side of the upstream stand necessary for making said rolling load amounts coincide with the load distribution ratio set value;

(d) changing the plate thickness at the exit side of the upstream stand by correcting the rolling reduction position at the upstream stand, based on $\Delta S_i=(-m_i+q_i/m_i)\cdot\Delta h_i^{L}$ (where $\Delta S_i$ is rolling reduction position of the ith stand, $q_i$ is the plastic hardness of the material being rolled, $\Delta h_i^{L}$ is the change value of the plate thickness at the ith stand); and (e) correcting the rolling reduction position at said downstream stand, based on $\Delta S_i+1=(q_{i+1}/m_{i+1})\cdot\Delta h^{iL}$ at the time when the plate thickness change point reaches the downstream stand.

2. A load distribution controlling method for a continuous rolling mill for rolling plate material, comprising the steps of:

(a) detecting rolling load amounts at a given pair of adjacent stands of said continuous rolling mill;

(b) judging whether the respective rolling load ratios coincide with a load distribution ratio set value or not by comparing the respective magnitudes with each other;

(c) calculating, if coincidence is not found, a change value $\Delta hi^{L}$ of plate thickness on the exit side of the upstream stand necessary for making said rolling load amounts coincide with the load distribution ratio set value;

(d) changing the plate thickness at the exit side of the upstream stand based on the change value of plate thickness at said exit side and by means of a roll force plate thickness controlling device for the upstream stand; and (e) correcting the rolling reduction position at the downstream stand by means of a feed forward plate thickness controlling device for the downstream stand at the time when the plate thickness changing point reaches said downstream stand.

* * * * *

UNITED STATES PATENT AND TRADEMARK OFFICE

CERTIFICATE OF CORRECTION

PATENT NO. : 4,614,098

DATED : September 30, 1986

INVENTOR(S) : Yoshikazu Kotera

It is certified that error appears in the above-identified patent and that said Letters Patent is hereby corrected as shown below:

Column 1, line 49, after "and" insert --the--.

Column 2, line 67, after "disturb" delete "to".

Column 3, line 31, after "each" insert --of--.

Column 4, line 39, in equation (12), "$(m_i+q_i m/i)$" should be --$(m_i+q_i/m_i)$--.

Signed and Sealed this

Fourteenth Day of April, 1987

*Attest:*

DONALD J. QUIGG

*Attesting Officer*

*Commissioner of Patents and Trademarks*